US012611040B2

(12) United States Patent
Wei

(10) Patent No.: US 12,611,040 B2
(45) Date of Patent: Apr. 28, 2026

(54) MODULAR SOFA

(71) Applicant: AuGroup technology Co., Ltd., Shenzhen (CN)

(72) Inventor: Yahong Wei, Shenzhen (CN)

(73) Assignee: AuGroup Technology Co., Ltd., Shenzhen (CN)

( * ) Notice: Subject to any disclaimer, the term of this patent is extended or adjusted under 35 U.S.C. 154(b) by 13 days.

(21) Appl. No.: 18/676,430

(22) Filed: May 28, 2024

(65) Prior Publication Data

US 2025/0280961 A1 Sep. 11, 2025

(30) Foreign Application Priority Data

Mar. 6, 2024 (CN) ..... 202420431493.3

(51) Int. Cl.

| | |
|---|---|
| ***A47C 17/13*** | (2006.01) |
| ***A47C 7/42*** | (2006.01) |
| ***A47C 13/00*** | (2006.01) |
| ***A47C 17/86*** | (2006.01) |

(52) U.S. Cl.

CPC ..... *A47C 17/132* (2013.01); *A47C 17/86* (2013.01); *A47C 7/42* (2013.01); *A47C 13/005* (2013.01)

(58) Field of Classification Search

CPC ..... A47C 17/132; A47C 17/86; A47C 13/005; A47C 7/40; A47C 7/42

USPC ..... 5/12.1

See application file for complete search history.

(56) References Cited

U.S. PATENT DOCUMENTS

| | | | | |
|---|---|---|---|---|
| 8,764,114 | B1 * | 7/2014 | Frank | A47C 7/42 297/440.16 |
| 2009/0045666 | A1 * | 2/2009 | Westendorf | A47C 13/005 297/440.1 |
| 2013/0341992 | A1 * | 12/2013 | King | A47C 13/005 403/361 |
| 2024/0108145 | A1 * | 4/2024 | Armond | A47C 13/005 |

FOREIGN PATENT DOCUMENTS

| | | | | |
|---|---|---|---|---|
| JP | 2012223484 A | * | 11/2012 | A47C 13/005 |
| WO | WO-2016001008 A1 | * | 1/2016 | A47C 7/42 |

OTHER PUBLICATIONS

Translation JP-2012223484-A (Year: 2025).*
Translation WO-2016001008-A1 (Year: 2026).*

* cited by examiner

*Primary Examiner* — J. T. Newton

(57) ABSTRACT

A sofa includes: a base assembly comprising a base that comprises at least one of a first connection member and a second connection member; wherein the first connection member is configured to detachably connect with a base connecting member, two bases are detachably connectable to each other through the first connection member and the base connecting member; the second connection member is configured to detachably connect with a backrest connecting member, thereby allowing a backrest connected to the backrest connecting member to be detachably connected to the base assembly.

10 Claims, 8 Drawing Sheets

MODULAR SOFA

CROSS REFERENCE TO RELATED APPLICATIONS

This application claims priority to Chinese Patent Application No. CN 202420431493.3, filed Mar. 6, 2024, which is hereby incorporated by reference herein as if set forth in its entirety.

TECHNICAL FIELD

The present disclosure generally relates to furniture, and in particular relates to a sofa.

BACKGROUND

Sofas usually include bases, backrest assemblies and armrest assemblies. For some sofas, these components are fixed to one another, and the final appearance of the sofa is fixed. It would therefore be advantageous to be able to assemble these components together in different ways to provide sofas of different configurations.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
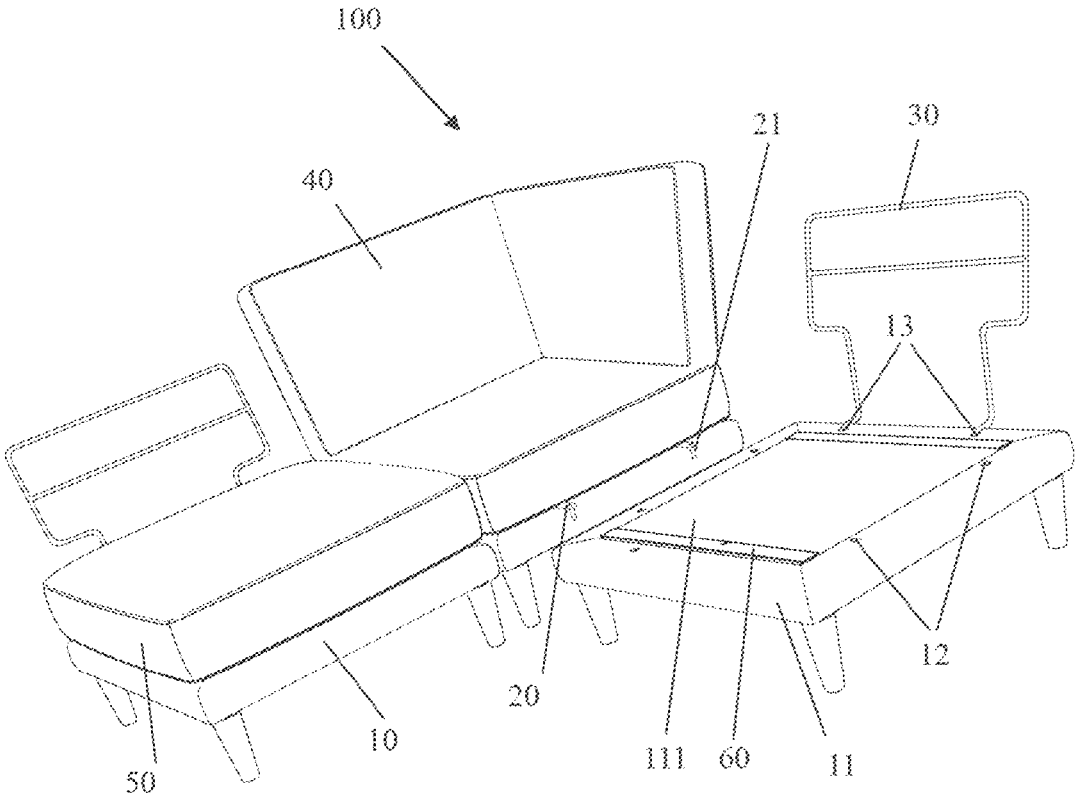
FIG. 1 is a schematic isometric view of a sofa according to one embodiment, in which some components are omitted.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
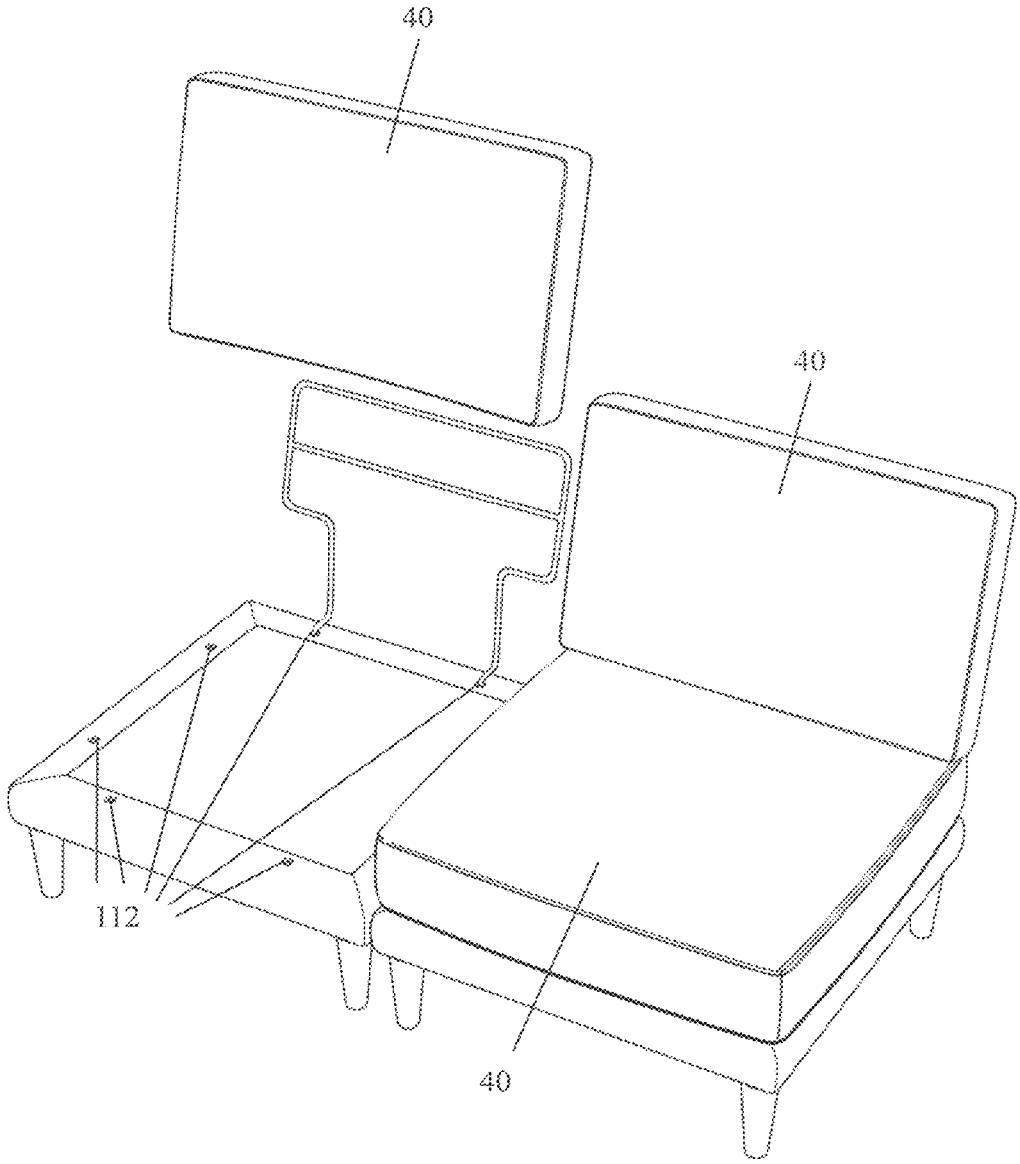
FIG. 2 is a schematic isometric view of a sofa (i.e., a two-seater sofa) according to another embodiment, in which some components are omitted and the backrest is in an exploded state.

Referring to FIGS. 1 and 2, in one embodiment, a sofa 100 includes at least one base assembly 10 that includes a base 11 including a first connection member 12 and/or a second connecting member 13. The first connection member 12 is to detachably connect with a base connecting member 20. Two bases 11 can be detachably connected to each other through the first connection member 12 and the base connecting member 20. With such configuration, two bases 11 of two sofas 100 can be assembled to form a new sofa. The second connection member 13 is to detachably connect with a backrest connecting member 30, thereby allowing the backrest 40 connected to the backrest connecting member 30 to be detachably connected to the base assembly 10.

With such configuration, different numbers of base assemblies 10 can be used to construct sofas of different structures. For example, a one-seater sofa can be constructed using a single base assembly 10; a two-seater sofa can be constructed using two base assemblies 10; and a three-seater sofa can be constructed using three base assemblies 10 and multiple base assemblies 10 can be assembled in different manners to form sofas with different structures.

In one embodiment, the base 11 is a flat cuboid, and the first connection member 12 and the second connecting member 13 can be disposed on the top surface of the base 11 and close to the edges. For example, the top surface 111 of the base 11 is provided with a number of receiving holes 112, and a first group of receiving holes among the receiving holes 112 constitutes the first connection member 12. As shown in FIG. 1, the two receiving holes 112 near the left side and the two receiving holes 112 near the right side of the base 11 respectively constitute two first connection members 12. A second group of receiving holes among the receiving holes 112 constitutes the second connecting member 13. As shown in FIG. 1, the two receiving holes 112 near the rear end of the base 11 constitute the second connecting member 13.

Figure 3:
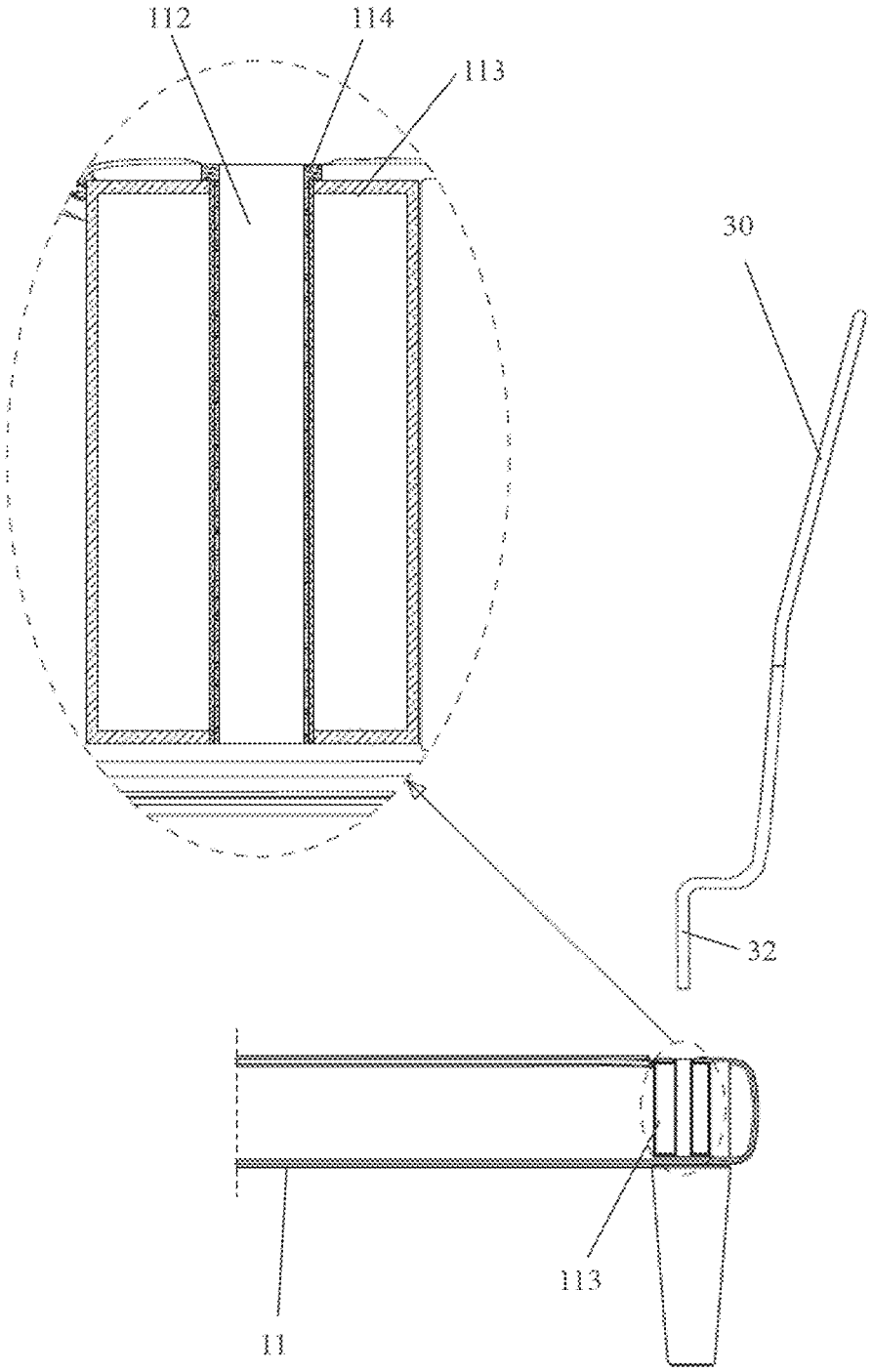
FIG. 3 is a schematic diagram showing the connection member of the base and the backrest of the sofa in an unconnected state.
Figure 4:
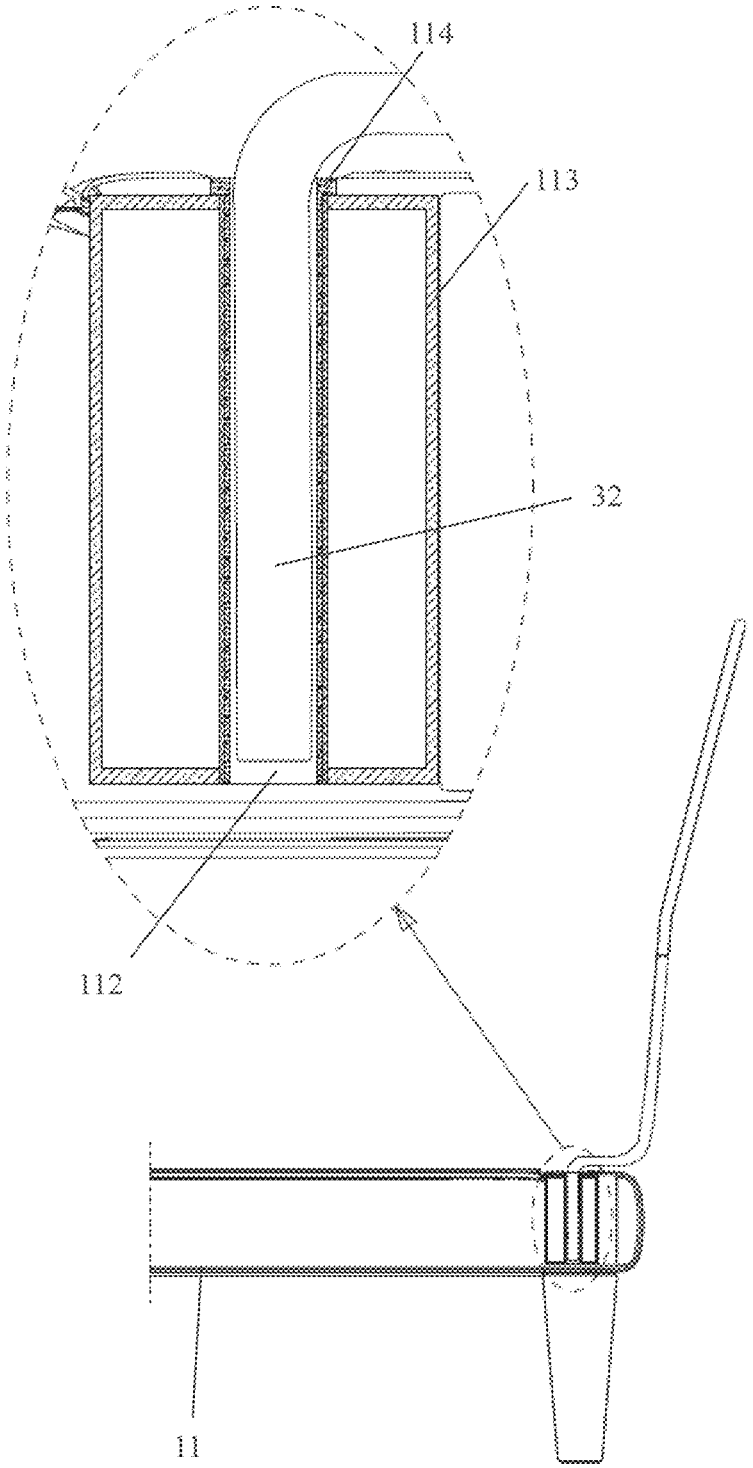
FIG. 4 is a schematic diagram showing the connection member of the base and the backrest of the sofa in a connected state.

Referring to FIGS. 3 and 4, in one embodiment, the base 11 includes a square metal frame 113 and a number of plastic members 114 embedded in the metal frame 113. The receiving holes 112 are respectively formed in the plastic members 114. The square metal frame 113 ensures the required support strength for the sofa 100. By forming the receiving holes 112 in the plastic members 114, it is advantageous for providing sufficient friction needed to connect the first connection member 12 and the second connection member 13 with the base connecting member 20 and the backrest connecting member 30. This allows the base connecting member 20 and the backrest connecting member 30 to be stably connected to the receiving holes 112.

In one embodiment, each base assembly 10 further includes a seat cushion 50 removably attached to its base 11. The seat cushion 50 is placed on the top surface of the base 11. The seat cushion 50 can not only provide comfortable support for the user, but also block the receiving hole 112 formed on the top surface of the base 11, so that the receiving holes 112 does not affect the aesthetics of the sofa 100.

In one embodiment, the seat cushion 50 can be detachably connected to the base 11 through a zipper or hook-and-loop fastener 60. This ensures that the seat cushion 50 does not easily move relative to the base 11.

In one embodiment, each base connecting member 20 includes two posts 21 spaced apart from each other and connected to each other. Two adjacent bases 11 of the bases 11 are detachably connected to each other through at least one base connecting member 20. The two posts 21 of the at least one base connecting member 20 are inserted into the receiving holes 112 of the two adjacent bases 11, respectively. In the embodiment shown in FIGS. 1 and 2, two adjacent bases 11 are detachably connected to each other through two base connecting members 20.

Figure 5:
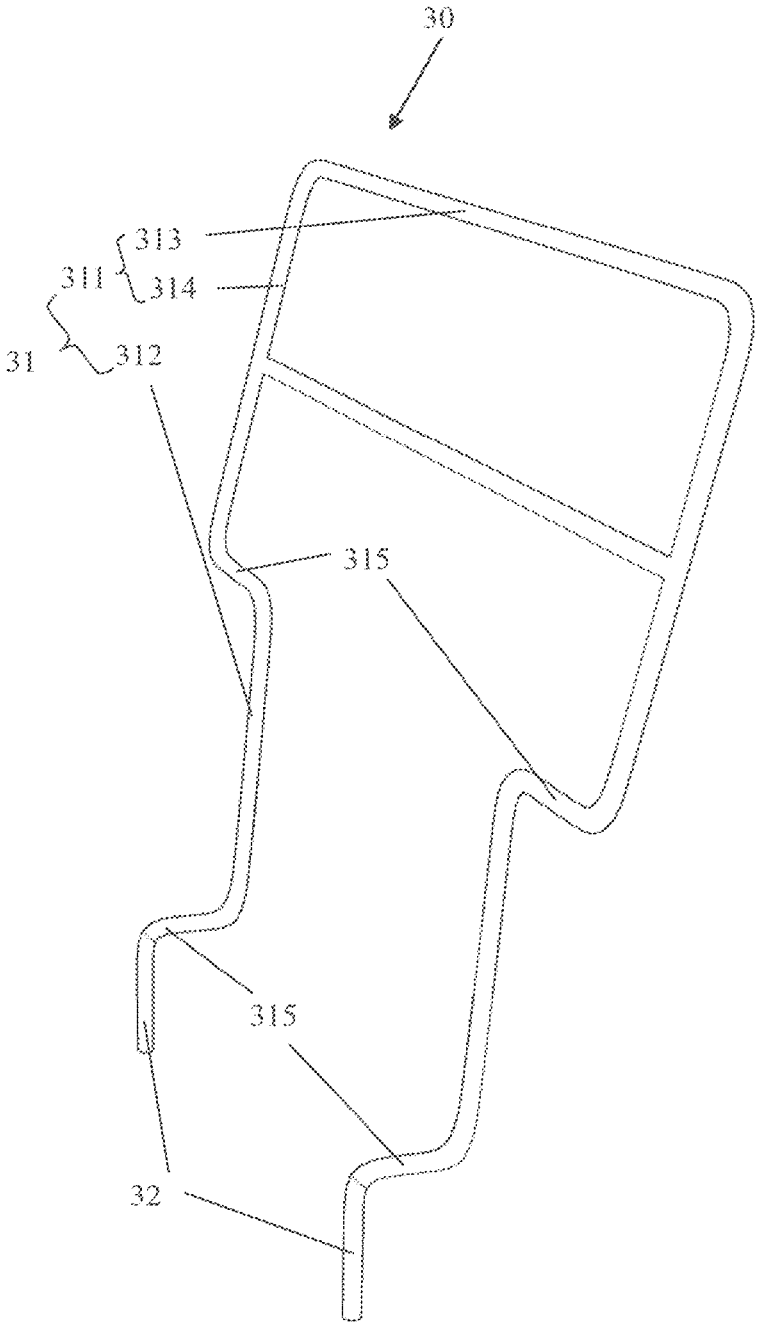
FIG. 5 is a schematic isometric view of the backrest connection member of the sofa according to one embodiment.
Figure 6:
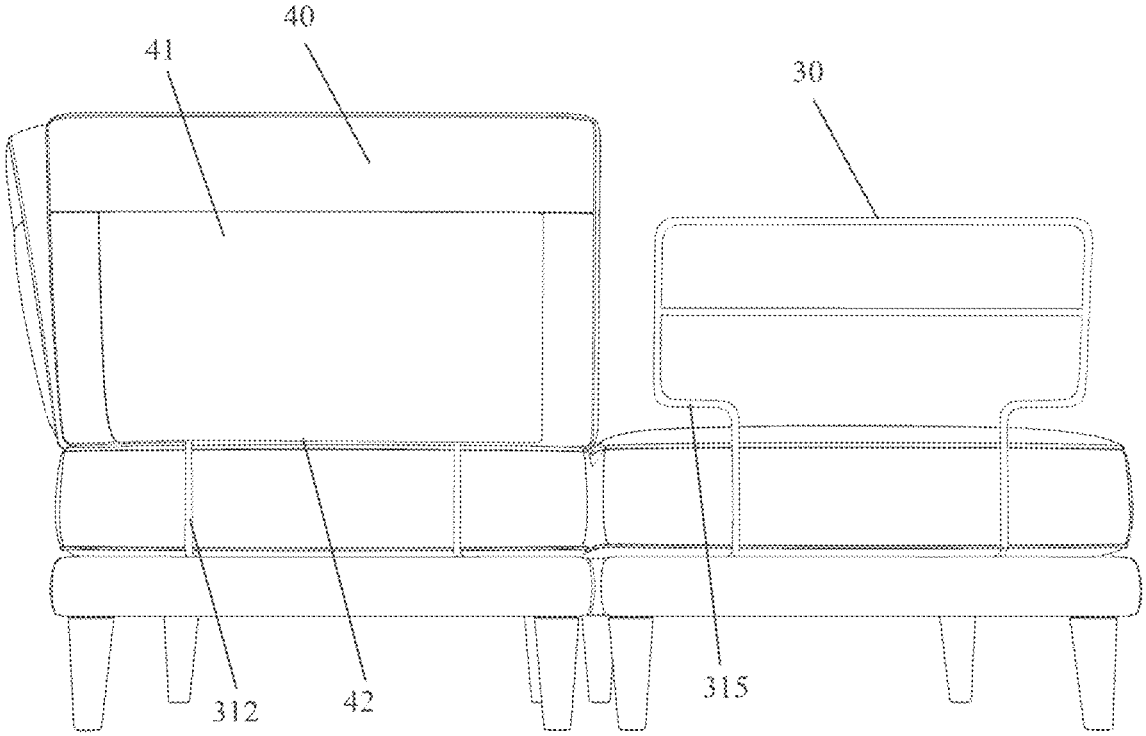
FIG. 6 is a rear view of a sofa (i.e., a two-seater sofa) according to another embodiment, in which some components are omitted.
Figure 7:
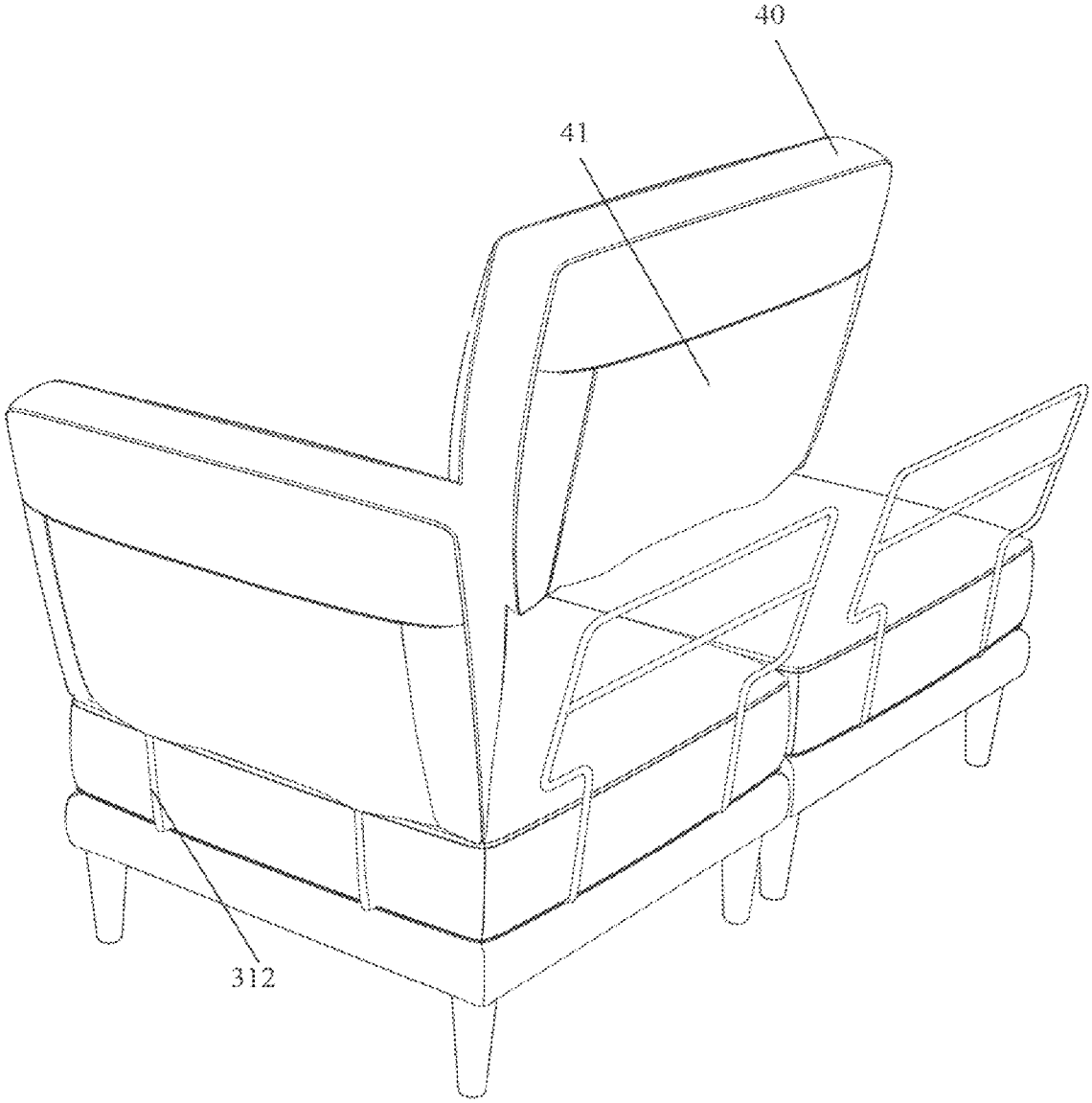
FIG. 7 is a schematic isometric view of the sofa shown in FIG. 6, in which some components are omitted.

Referring to FIGS. 5 to 7, in one embodiment, the backrest connecting member 30 includes a support frame 31 and two insertion portions 32 connected to the support frame 31. The insertion portions 32 can be inserted into the first group of receiving holes 112. In one embodiment, the insertion portions 32 are located below the support frame 31.

In one embodiment, the backrest connecting member 30 includes a number of bars connected to one another. The support frame 31 includes a main body 311 and two support bars 312 located below the main body 311. The main body 311 includes a horizontal bar 313 and two longitudinal bars 314 connected to opposite ends of the horizontal bar 313. The ends of the two longitudinal bars 314 away from the horizontal bar 313 have connecting bars 315 extending toward each other. The two support bars 312 are respectively connected to the ends of the two connecting bars 315. In this way, the distance between the two support bars 312 is less than the distance between the two longitudinal bars 314, that is, the distance between the two support bars 312 is less than the width of the bracket body 311.

Referring to FIGS. 5 and 6, in one embodiment, the backrest 40 includes a connection member 41 provided on its back. For example, a square piece of fabric can be sewn to the back of the backrest 40 to form a square connection member 41, and three sides of the square piece of fabric can be sewn to the back of the backrest 40. A receiving space is formed between the square piece of fabric and the back of the backrest 40, and an opening 42 is formed between the last side of the square piece of fabric and the back of the backrest 40. Through the opening 42, the backrest connecting member 30 can penetrate deeply into the receiving space, thereby detachably connecting the backrest 40 to the backrest connecting member 30 and further to the base 11.

Figure 8:
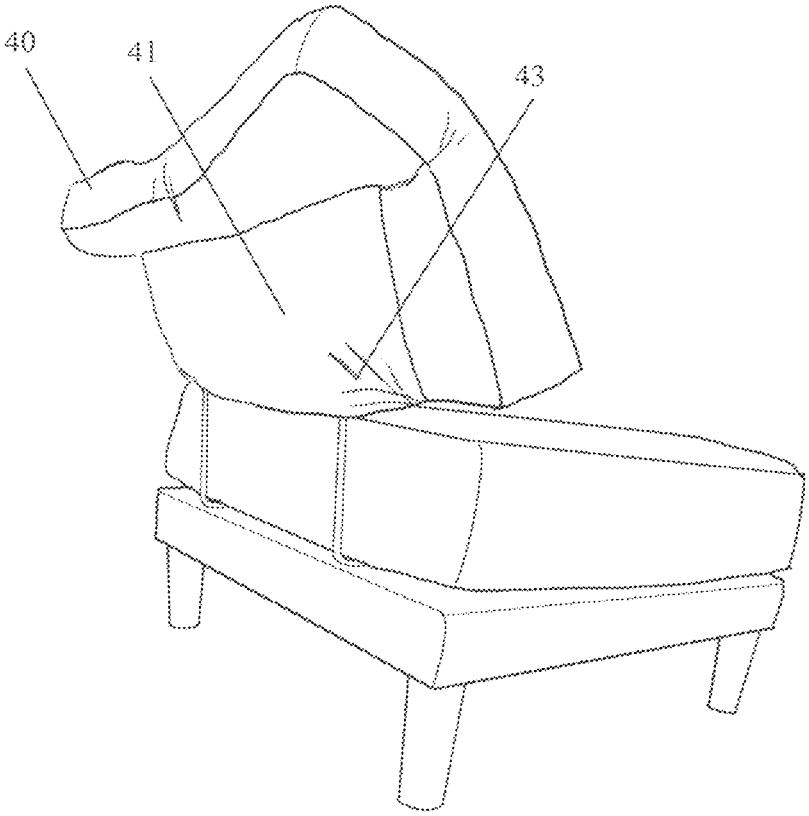
FIG. 8 is a schematic isometric view of a sofa (i.e., a one-seater sofa) according to another embodiment.

In one embodiment, the main body 311 and the two support bars 312 are substantially on the same plane, or the plane where the main body 311 is located may be inclined relative to the plane where the two support bars 312 are located. The ends of the two support bars 312 away from the main body 311 are provided with connecting bars 316. The two connecting bars 316 are substantially perpendicular to the support bars 312. The two insertion portions 32 are respectively connected to the ends of the connecting bars 316. The two insertion portions 32 are both rod-shaped and substantially parallel to each other. When the two insertion portions 32 are inserted into the two receiving holes 112 of a base 11, the connecting bars 315 of the backrest connecting member 30 is higher than the seat cushion 50. When the backrest 40 is connected to the backrest connecting member 30, the opening 42 of the connection member 41 of the backrest 40 is located below the connecting bars 315. Referring to FIG. 8, when a user leans on the backrest 40, the portion 43 of the connection member 41 of the backrest 40 close to the opening 42 tightly contacts the connecting bars 315, which can prevent the connection member 41 of the backrest 40 from being separated from the backrest connecting member 30.

With such configuration, a single base assembly 10 can be used as a sofa; a single base assembly 10, backrest connecting member 30 and backrest 40 can be connected to one another to form a one-seater sofa; and two one-seater sofas can be connected together through one or two base connecting members 20 to form a two-seater sofa, as shown in FIG. 2. A two-seater sofa can be combined with a footstool ottoman. Additionally, a two-seater sofa, a one-seater sofa, and one or two base connecting members 20 can be connected together to form a three-seater sofa. Therefore, it can be seen that the sofa provided according to the above-mentioned embodiments can form different configurations through various installation methods.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A sofa comprising:

a base assembly comprising a base that comprises at least one of a first connection member and a second connection member;

a backrest;

a backrest connecting member connected to the backrest; and a third connection member connected to a back of the backrest, forming a receiving space with an opening; the backrest connecting member penetrating into the receiving space through the opening, thereby detachably connecting the backrest to the backrest connecting member;

wherein the first connection member is configured to detachably connect with a base connecting member, two bases are detachably connectable to each other through the first connection member and the base connecting member;

wherein the second connection member is configured to detachably connect with the backrest connecting member, thereby allowing the backrest connected to the backrest connecting member to be detachably connected to the base assembly;

wherein the backrest connecting member comprises at least one connecting bar, and the at least one connecting bar is located above the opening of the receiving space and is configured to tightly contact a portion of the third connection member close to the opening, thereby preventing the third connection member from being separated from the backrest connecting member.

2. The sofa of claim 1, wherein the base comprises a top surface that defines a plurality of receiving holes, and a first group of receiving holes among the plurality of the receiving holes constitutes the first connection member, and a second group of receiving holes among the plurality of the receiving holes constitutes the second connection member.

3. A sofa comprising:

two base assemblies, each of the base assemblies comprising a base that comprises a first connection member and a second connection member;

two backrests;

two backrest connecting members, the backrest connecting members detachably connected to the second connection members of the bases of the two base assemblies, respectively, and connected to the two backrests, respectively, thereby detachably connecting the two backrests to the bases of the two base assemblies;

a third connection member connected to a back of each of the two backrests, forming a receiving space with an opening; the two backrest connecting members penetrating into the receiving spaces through the two openings, respectively, thereby detachably connecting the backrests to the backrest connecting members, respectively;

wherein each of the two backrest connecting members comprises at least one connecting bar, and the at least one connecting bar is located above the opening of the receiving space corresponding thereto and is configured to tightly contact a portion of the third connection member corresponding thereto close to the opening, thereby preventing the third connection member from being separated from the backrest connecting member corresponding thereto.

4. The sofa of claim 3, wherein each of the bases comprises a top surface that defines a plurality of receiving holes, and a first group of receiving holes among the plurality of the receiving holes constitutes the first connection member, and a second group of receiving holes among the plurality of the receiving holes constitutes the second connection member.

5. The sofa of claim 3, wherein each of the base assemblies comprises a seat cushion removably attached to a corresponding one of the bases.

6. The sofa of claim 5, wherein each of the seat cushion is detachably connected to the corresponding one of the bases through a zipper or hook-and-loop fastener.

7. The sofa of claim 4, wherein each of the backrest connecting members comprises a support frame and two insertion portions connected to the support frame, and the insertion portions are inserted into the first group of receiving holes.

8. The sofa of claim 7, wherein the support frame comprises a main body and two support bars located below the main body, the two support bars are connected to the main body and the insertion portions, and a distance between the two support bars is smaller than a width of the main body, a number of the at least one connecting bar is two, and the two connecting bars are respectively connected to the main body and the two support bars.

9. The sofa of claim 4, wherein each of the bases comprises a metal frame and a plurality of plastic members embedded in the metal frame, and the plurality of receiving holes are respectively formed in the plurality of plastic members.

10. A sofa comprising:

a plurality of base assemblies, each of the base assemblies comprising a base that defines a plurality of receiving holes;

a plurality of base connecting members, each of the base connecting members comprising two posts that are connected to and spaced apart from each other, each two adjacent ones of the bases detachably connected to each other through at least one of the base connecting members, wherein the two posts of each of the at least one of the base connecting members are inserted into the receiving holes of the two adjacent ones of the bases;

a backrest;

a backrest connecting member comprising a support frame and two insertion portions connected to the support frame, the backrest detachably connected to the support frame, the two insertion portions inserted into two of the receiving holes of the base of one of the base assemblies so as to detachably connect the backrest to the base of the one of the base assemblies;

a third connection member connected to a back of the backrest, forming a receiving space with an opening; the backrest connecting member penetrating into the receiving space through the opening, thereby detachably connecting the backrest to the backrest connecting member; wherein the backrest connecting member comprises at least one connecting bar, and the at least one connecting bar is located above the opening of the receiving space and is configured to tightly contact a portion of the third connection member close to the opening, thereby preventing the third connection member from being separated from the backrest connecting member.

* * * * *